US005690273A

United States Patent [19]

Jensen

[11] Patent Number: 5,690,273

[45] Date of Patent: Nov. 25, 1997

[54] PAPERBOARD CONTAINER WITH INDICIA TABS

[75] Inventor: Kurt D. Jensen, Cincinnati, Ohio

[73] Assignee: International Paper Company, Purchase, N.Y.

[21] Appl. No.: 784,173

[22] Filed: Jan. 15, 1997

Related U.S. Application Data

[62] Division of Ser. No. 620,234, Mar. 22, 1996.

[51] Int. Cl.[6] ..... B65D 5/42

[52] U.S. Cl. ..... 229/107; 206/459.5; 229/116.1; 229/938

[58] Field of Search ..... 229/107, 116.1, 229/938; 206/459.1, 459.5; 40/312, 359, 492, 513; 426/115

[56] References Cited

U.S. PATENT DOCUMENTS

| | | | |
|---|---|---|---|
| Re. 33,979 | 6/1992 | Cortopassi | 229/902 |
| 248,353 | 10/1881 | Schilling . | |
| 2,054,596 | 9/1936 | Ford | 206/459.1 |
| 2,877,736 | 3/1959 | Simmons | 206/459.1 |
| 2,878,814 | 3/1959 | Consaul | 40/359 |
| 3,071,882 | 1/1963 | Eisman et al. . | |
| 3,205,603 | 9/1965 | Brumley . | |
| 3,371,850 | 3/1968 | Gorman | 40/492 |
| 4,004,691 | 1/1977 | Wihksne | 206/459.1 |
| 4,444,354 | 4/1984 | Staelgraeve | 40/312 |
| 4,472,896 | 9/1984 | Brauner et al. | 40/312 |
| 4,535,929 | 8/1985 | Sherman, II et al. | 206/459.1 |
| 4,630,733 | 12/1986 | Fear | 206/459.1 |
| 4,750,668 | 6/1988 | Behne . | |
| 4,805,775 | 2/1989 | Fear . | |
| 4,901,457 | 2/1990 | Chandler | 40/312 |
| 5,421,508 | 6/1995 | Beales | 229/107 |
| 5,518,169 | 5/1996 | Beales | 229/107 |

FOREIGN PATENT DOCUMENTS

| | | | |
|---|---|---|---|
| 2239286 | 2/1975 | France | 206/459.1 |

*Primary Examiner*—Gary E. Elkins
*Attorney, Agent, or Firm*—Michael J. Doyle

[57] ABSTRACT

An indicia tab construction for a paperboard food wrapper or container. In one embodiment a peripheral indicia tab is foldable about a lateral axis to assume one of two configurations, and is held in a folded configuration by a cohesive layer. In a second embodiment each of a plurality of peripheral indicia tabs is foldable about respective aligned axes and is also held in folded configurations by respective cohesive layers. In a third embodiment one or more foldable indicia tabs are attached to the periphery of one half of a foldable food wrapper, each tab provided with a legend or other indicia normally viewable. These tabs may be, selectively, folded so as to uncover other legends or indicia, normally covered, on the other wrapper half.

3 Claims, 4 Drawing Sheets

FIG. 1
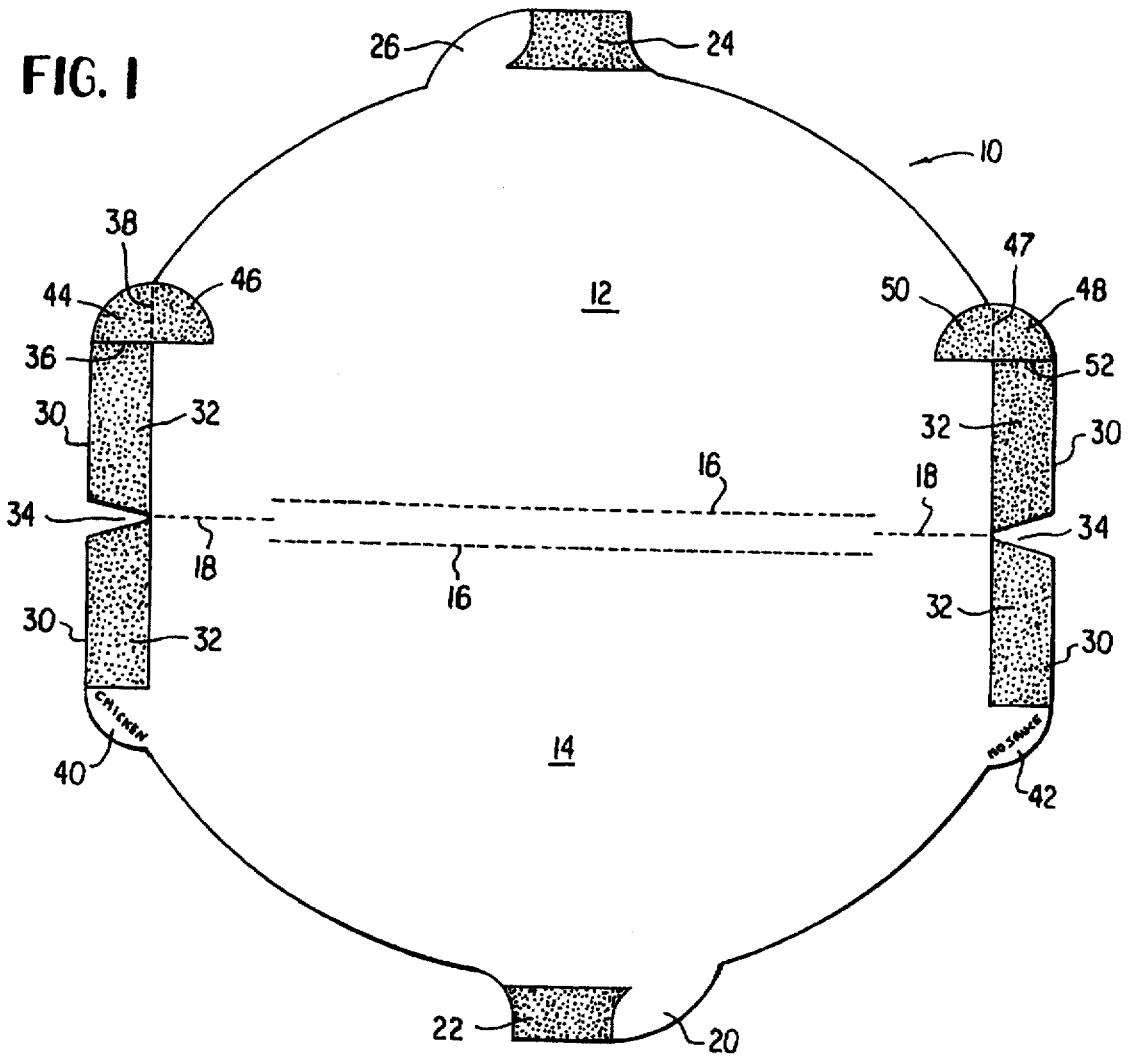
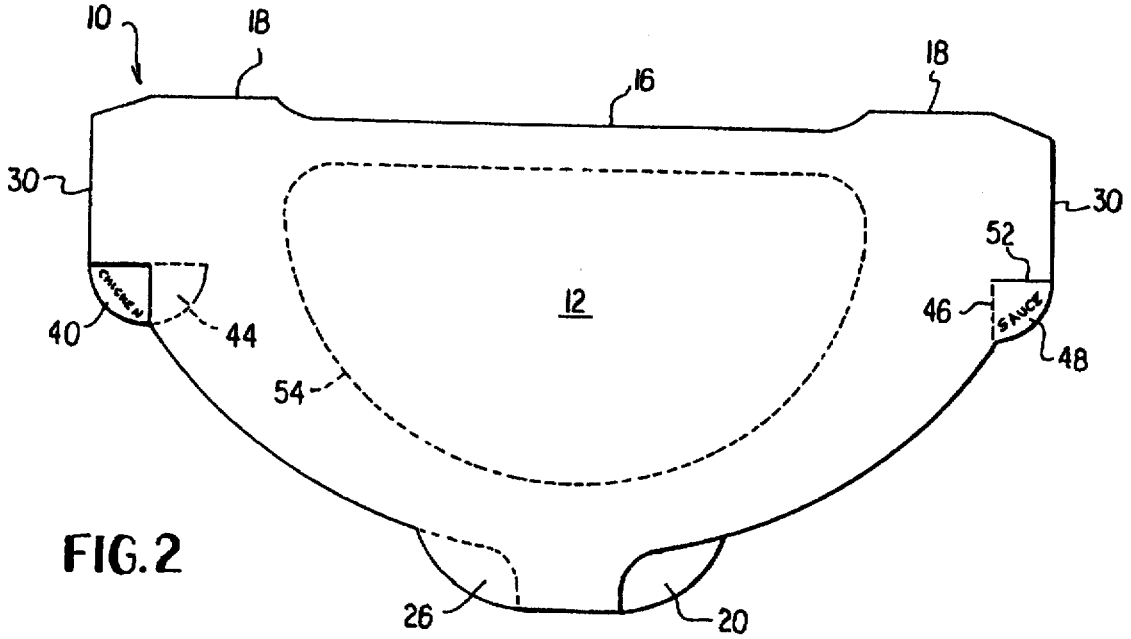
FIG. 2

PAPERBOARD CONTAINER WITH INDICIA TABS

This is a division of application Ser. No. 08/620,234 filed Mar. 22, 1996, pending.

BACKGROUND OF THE INVENTION

This invention relates to an indicia tab construction for a paperboard container and exhibits particular utility with containers of the type illustrated in U.S. Pat. No. 5,421,508 issued to Beales. In the Beales construction a generally circular paperboard blank is provided with substantially diagonally running fold lines to permit a certain type of folding to form a container for a thin food item without squeezing the item, with the periphery of the blank provided having interengaging latching elements so as to permit a releasable latching of the container when it is folded about the several diametrical fold lines to enclose and package a food item.

In this type of container, as well as in other types of containers particularly adapted for fast food, there exists a need for indicia so that the assembler of the carry-out food package may readily designate the contents of the container to thereby inform both any intermediate server and the ultimate purchaser of the contents. Apart from manually marking the contents as with a crayon or pencil, the container art has evolved a variety of indicia tab constructions for this purpose.

While somewhat satisfactory for food container marking purposes, prior indicia tab constructions do not exhibit the advantages of the present invention.

SUMMARY OF THE INVENTION

According to the practice of this invention, a food holder is provided with an indicia tab construction which employs both indicia tabs as well as cohesive material on the tab surfaces. In one embodiment, a plurality of tabs, with each bearing a different indicia, is provided along a peripheral portion of a food container. The contents identification of the container is made by folding one or more of the tabs 180° against a portion of the food container, thereby leaving only those tabs which will identify the container contents. Cohesive materials are characterized by their ability or property to releasably adhere to other cohesive materials, but which will not adhere to non-cohesive materials. According to another embodiment of the invention, an indicia tab is provided with different indicia on each of its two surfaces or sides, the action being such that if the tab is not bent, one indicia is normally visible, while if the tab is folded 180° to a different position, a different indicia on the other surface of the tab is visible. According to yet another embodiment, a foldable food container is provided with overlapping indicia tabs, with one of the tabs adapted to be folded 180° to thereby expose a second and normally obscured indicia on the container.

BRIEF DESCRIPTION OF THE DRAWINGS

FIG. 1 is a plan view of the interior forming side of a paperboard blank embodying the indicia tab construction according to one embodiment of this invention.

FIG. 2 is a view of the blank of FIG. 1 after its folding.

DETAILED DESCRIPTION OF THE INVENTION

Figure 3:
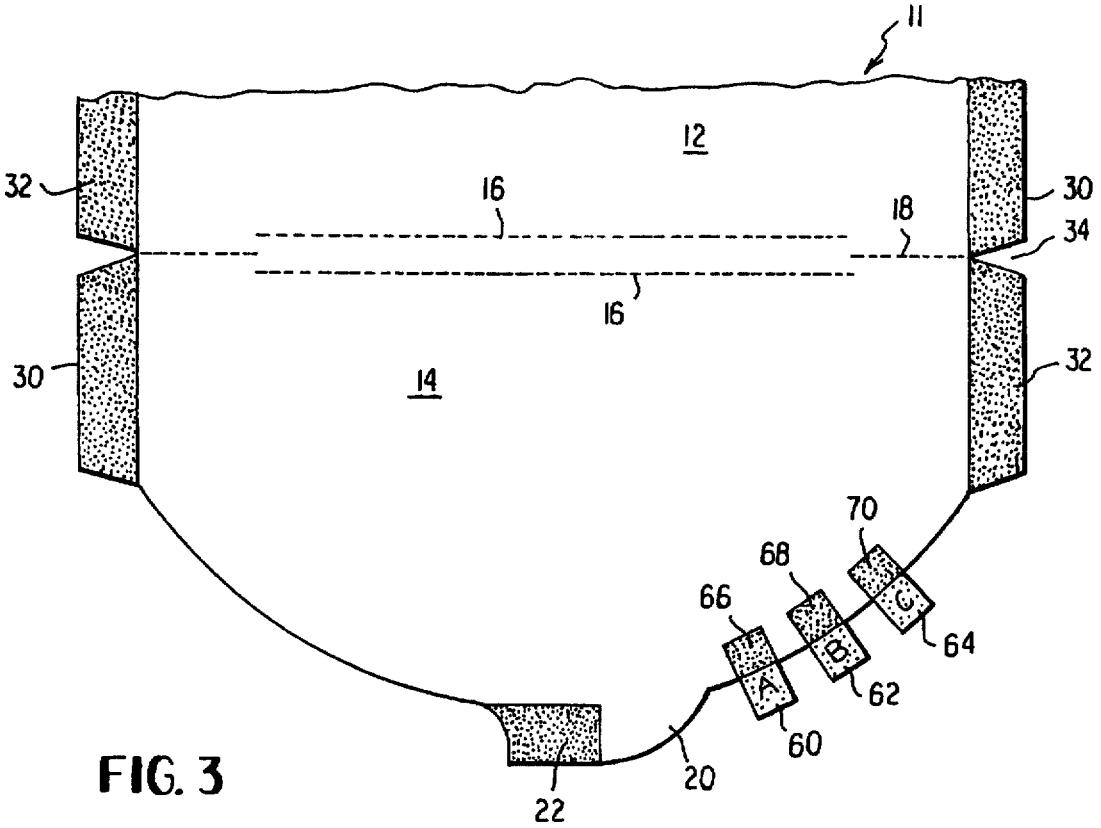
FIG. 3 is a partial plan view of a lower portion of a blank similar to that illustrated at FIG. 1, showing a second embodiment of the indicia tab construction of this invention.

Referring now to FIG. 1, a generally circular unitary blank 10 of paperboard is provided with upper and lower halves 12 and 14, respectively, and diametrically extending fold lines 16 which run substantially centrally across the blank. Aligned fold lines 18, also fashioned from scores for example, extend from the periphery partially radially inwardly. A lower ear 20 is provided on one portion thereof with a cohesive substance, such as one sold under the trade name Nipwell, marketed by Findley Co. of Wisconsin or sold under the trade name Sci-Bond, marketed by SCI Inc. of New Jersey. Typically, the cohesive is a water based cold seal adhesive.

Similarly, an upper ear 26 is partially provided with a cohesive coating 24. The left part of the blank is provided with a pair of ears 30, as is the right half, with these ears being covered with a layer of the cohesive material 32, denoted by .stippling. Ears 30 are of the same shape and area. A triangular shaped gap 34 separates upper and lower ears 30 at the right and left sides of blank 10. At the left half, cut line 36, extending completely through the paperboard, is positioned at the top border of upper left ear 30, with fold or score line 38 extending vertically downwardly from the blank periphery to the upper border of left upper cohesive area 32. Quarter-circular regions 44 and 46 are positioned to the left and right, respectively, of fold line 38.

Turning now to the right hand portion of blank 10, cut line 52, also extending completely through the paperboard, is located above the upper right ear 30, with fold or score line 46 extending vertically from the periphery and aligned with the left border of upper right ear 30. Quarter-circular portions 48 and 50, respectively to the right and left of fold line 46, are each coated with cohesive material 32, again indicated by stippling.

At the lower left portion of the blank, an enlargement 40 is provided on the blank periphery and may be provided with a first indicia, such as "chicken." Similarly, another enlargement 42, provided at the lower right blank periphery, is provided with another indicia, such as "no sauce."

It will be understand that the blank surface facing the reader of FIG. 1 will be the interior of the container after blank folding.

Referring now to FIG. 2, the blank of FIG. 1 has been folded about fold lines 16 and 18 to assume a closed configuration, with cohesive material 32 on ears 30, and cohesive material 22, 24 on respective ears 20 and 26 all releasably holding the blank folded so as to enclose a flat food item 54. That portion of semicircular region 48 which faces away. from the reader at FIG. 1 is provided with another indicia, such as "sauce." Similarly, at the left portion of FIG. 2, the opposite surface (facing away from the reader in FIG. 1) of left enlargement 40 is provided with another indicia, such as "cheese."

During the packaging operation, a relatively flat food item 54 is placed, for example, on lower half 14 (facing the reader) of blank 10, with upper half 12 folded over. Cohesive areas 22 and 24 form an easily openable latch, being pushed apart by opposite forces on ears 20, 26, while cohesive areas 30 at the diametrical portions of the blank also forming a readily releasable securement. Thus, cohesive regions 22, 24 and the four cohesive areas 30 serve to close the container and maintain the periphery in a relatively tight condition. If the food item requiring "sauce" and "chicken" is desired, the preparer of the package, prior to final folding and closing, folds quarter circular flap 44 at the upper left of FIG. 1 onto cohesive area 46, so that the legend "cheese" which appeared on its surface (the opposite surface from shown at FIG. 1) will not be seen and the indicia "chicken" will be displayed from enlargement 40, as shown at FIG. 2. FIG. 2 also indicates, in phantom lines, that quarter circular flap 44 has been folded about line 35 to now reside against cohesive area 46, thus exposing "chicken." Similarly, if "sauce" is desired with the "chicken," then one quarter circular flap 48, at the upper right of FIG. 1, is not folded, as opposed to being bent about fold line 47, so that the legend "sauce," on quarter circular flap 48, covers and obscures the legend "no sauce" at enlargement 42. Thus, four distinct visual combinations are possible by a mere folding or not folding quarter circular areas 44 and 48 against cohesive flaps 46 and 50, respectively.

Figure 4:
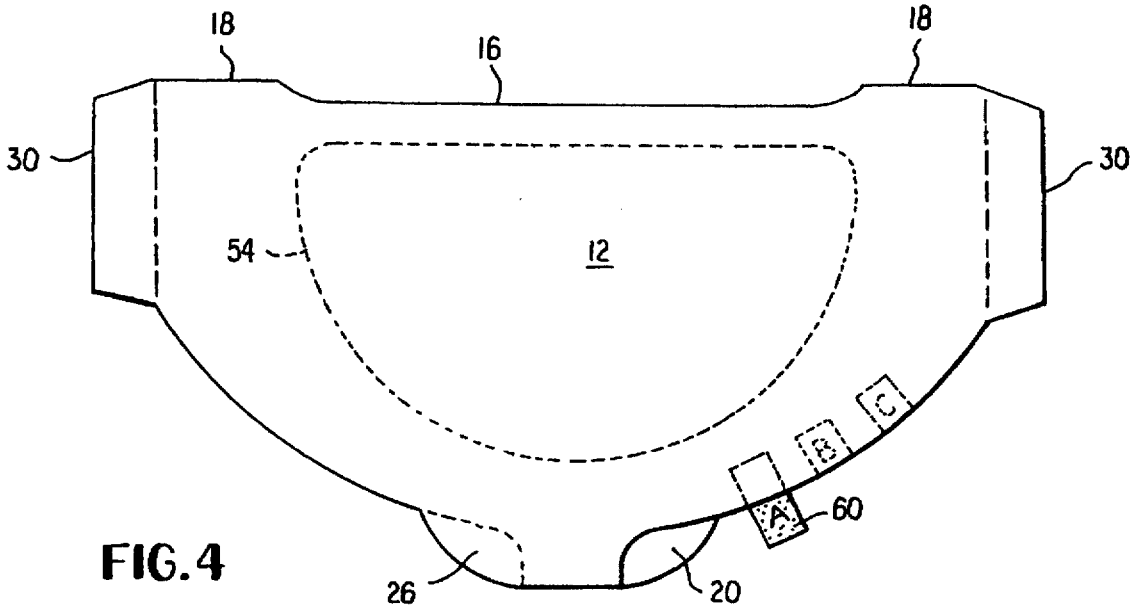
FIG. 4 is a view similar to FIG. 2, and illustrates the blank of FIG. 3 after folding.

Referring now to the embodiment of FIGS. 3 and 4, FIG. 3 is a view of the lower half 14 of a blank 11 similar to that of blank 10, except that blank 11 does not include enlargements 40 and 42 or one quarter circular flaps 44, and 46 or cohesive areas 48 and 50, or fold lines 38, 46. Instead, one lower peripheral portion of blank 11 is provided with a plurality of integral indicia tabs designated as 60, 62 and 64 and bearing indicia, for example, A, B and C. The indicia is shown as on those tab sides facing the reader, but could be located on those tab sides or surfaces facing away from the reader. Indicia tabs 60, 62 and 64 extend radially outwardly from the periphery of the lower portion of the blank, with corresponding and aligned cohesive areas 66, 68, and 70, the latter shown by stippling. Cohesive material, indicated by stippling, is coated on those indicia tab surfaces facing the reader. In operation, if a food item corresponding to indicia A on tab 60 is to be served, then the other two tabs 62 and 64 are folded so that the cohesive material thereon (facing the reader of FIG. 3) will engage respective cohesive areas 68 and 70. A food item 54, such as a flat food item, is now placed on lower blank half 14. The blank is then folded to assume the configuration shown in FIG. 4, with only indicia tab 60 in view, displaying the indicia A. Again, the blank is maintained folded by the mating cohesive areas on the peripheral ears 30 and 20, 26 (the latter not shown).The folded blank is easily opened by pushing in opposite directions on respective tabs 20 and 26.

Figure 5:
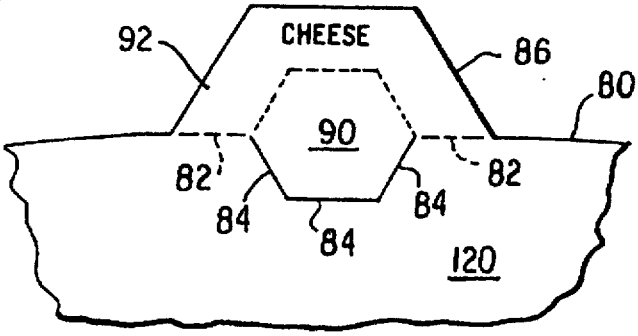
FIGS. 5 and 6 illustrate two configurations of an alternative or third embodiment of the invention.
Figure 6:
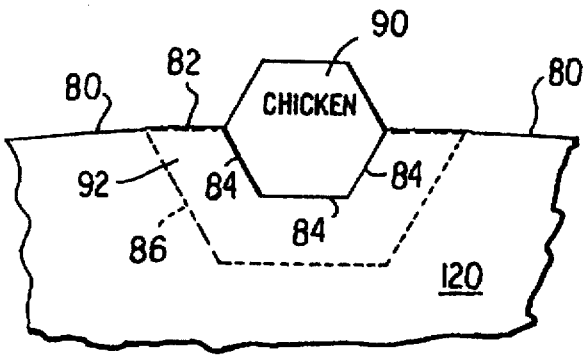
Figure 7:
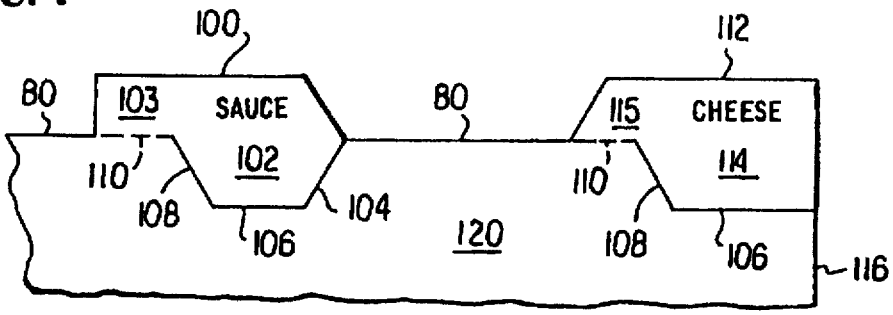
FIGS. 7 and 8 show a variation of the third embodiment of at FIGS. 5 and 6.
Figure 9:
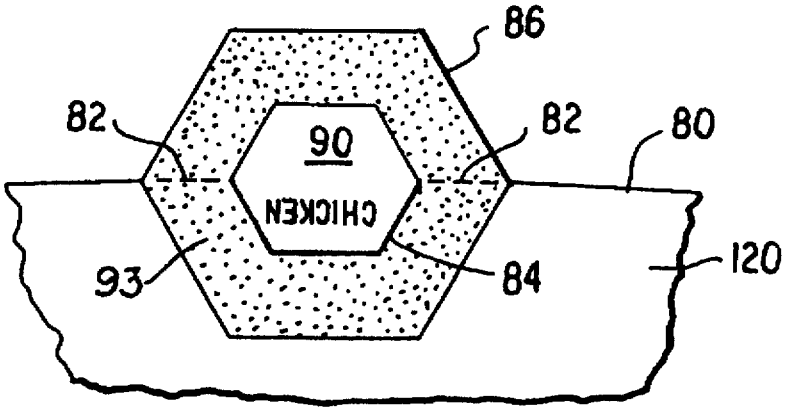
FIG. 9 is a view taken from the rear of FIG. 5 and illustrates a cohesive layer or pattern on those surfaces opposite to those as seen by the reader of FIG. 5.

Now referring to FIGS. 5 and 6, a peripheral portion of a paperboard container is illustrated, having for example an upper portion or region 120. The tab(s) of FIGS. 5 and 7 are shown as extending upwardly for ease in description, they could however extend downwardly or to the right or to the left, as will be apparent. One peripheral portion of the container is designated as 80, with a pair of fold lines 82 peripherally spaced from each other. The region 120 could be for example a peripheral portion of a blank similar to blank 10 or blank 11. Cuts 84, extending through the paperboard, are connected with each other and with respective ends of fold lines 82. A tab is denoted as 86 and has a cohesive coating on its opposite surface from that seen by the reader at FIG. 5. A cohesive layer or pattern 92 is bordered by the periphery of tab 86, fold lines 82, and the indicated phantom lines, the latter being mirror images of cut lines 84. The pattern 92 of cohesive material is located on the opposite surface (see stippled areas of FIG. 9) of region 120 from that seen by the reader of FIG. 5. In operation, if one indicia such as "cheese," facing the reader of FIG. 5, denotes the food item to be served, then nothing is done to the tab by the server or packager. On the other hand, if another food item is to be served, then tab 86 is folded rearwardly, 180°, about fold lines 82, as shown at FIG. 6, so that another indicia, such as "chicken" on interior portion 90 of tab 86 is now visible above cut lines 84. Cohesive pattern 92 holds tab 86 in the bent back position shown at FIG. 6, with this cohesive layer or pattern 92 contacting similar cohesive material 93 on the opposite surface (see FIG. 9) of region 120.

Figure 8:
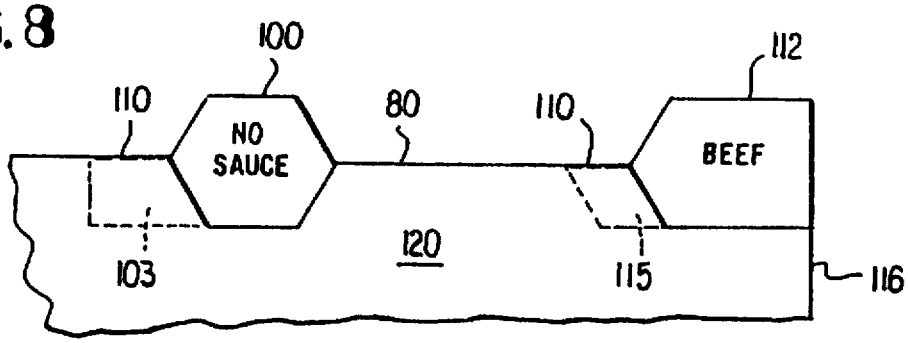
Figure 10:
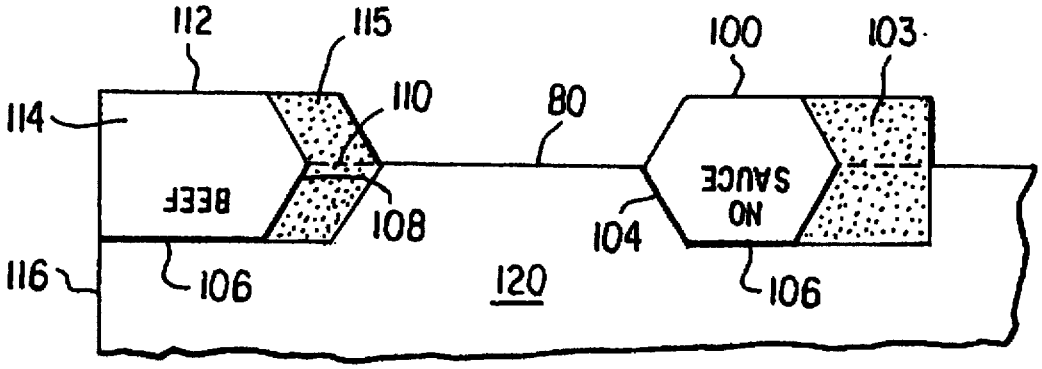
FIG. 10 is a view taken from the rear of FIG. 7 and illustrates cohesive layers or patterns on those surfaces opposite to those as seen by the reader of FIG. 7.

Referring now to the embodiment of FIGS. 7 and 8, FIG. 7 shows another container peripheral region or portion 120, here provided with two indicia tabs 100 and 112. Tab 100 includes a central region or zone 102, the latter bordered by cuts 104, 106, and 108, with one end of cut 108 communicating with a score or fold line 110. These cuts extend through the paperboard. Again, a peripheral edge is denoted as 80. The other indicia tab 112 is similar and has a central zone 114. The right edge of tab 112 is aligned with an edge 116 of region 120. Each of regions 103 of tab 100 and 115 of tab 112, as well as each of those regions immediately beneath them, opposite to the reader of FIG. 7, is provided with a cohesive layer, see FIG. 10. That surface of each of tabs 100 and 112 facing the reader of FIG. 7 carries an indicia, as seen. That surface of each tab 100, 112 facing away from the reader is also provided with an indicia, see FIG. 10.

In operation, tab 100 may be bent 180 degrees so as to expose the rear indicia, as seen by a comparison of FIGS. 7 and 8. In FIG. 8, the cohesive layer on region 103 sticks against the cohesive layer on the rear or opposite surface of zone 120. Similarly, tab 112, defined by cuts 106, 108, and score line 110, may be bent 180 degrees so that its cohesive layer on the opposite surface of region 115 sticks to a complementary cohesive layer on the opposite surface of region 120. It is seen that these two tabs 110, 112 and the cohesive layers yield a total of four combinations of container contents by the expedient of simply bending or not bending them individually about their respective fold axes 110 when a food package is prepared.

I claim:

1. An indicia tab construction particularly adapted for a paperboard food container having a peripheral edge portion, a tab formed from said paperboard food container, a first segment of said tab extending outwardly relative to said peripheral edge portion, a second segment of said tab extending inwardly relative to said peripheral edge portion, an integral hinge joining said tab to said container at said periphery, said second tab segment defined by a cut entirely through said paperboard, said tab having respective first and second opposite surfaces, said tab being foldable substantially 180 degrees about said integral hinge from a first, normal position to a second position, said cut being laterally spaced from said integral hinge, means carried by said tab, or by said container, or both, for adhesively releasably securing said tab in said substantially 180 degree second position, a first indicia on said first tab surface, a second and different indicia on said second tab surface, whereby said tab can be folded substantially 180 degrees to present two different indicia to a viewer.

2. The tab construction of claim 1 wherein said tab has two of said integral hinges, said hinges being spaced from each other along said periphery.

3. The tab construction of claim 2 including a notch between said two hinges, said notch defined by said cut, said notch at least partially surrounding said second tab segment in said tab normal position.

* * * * *